United States Patent [19]

Savage

[11] Patent Number: 4,502,191

[45] Date of Patent: Mar. 5, 1985

[54] STRAP BUCKLE

[75] Inventor: Garry Savage, Montreal, Canada

[73] Assignee: Institut de Recherche en Sante et en Securite du Travail du Quebec, Montreal, Canada

[21] Appl. No.: 504,301

[22] Filed: Jun. 14, 1983

[30] Foreign Application Priority Data

May 6, 1983 [CA] Canada ..... 427636

[51] Int. Cl.[3] ..... A44B 13/02; A44B 19/00

[52] U.S. Cl. ..... 24/580; 24/575; 24/583; 24/702

[58] Field of Search ..... 24/580, 582, 583, 575, 24/579, 578, 572, 615, 702, 653, 656, 171, 194; 248/58

[56] References Cited

U.S. PATENT DOCUMENTS

| | | | |
|---|---|---|---|
| 82,142 | 9/1868 | McDonald | 24/580 |
| 796,414 | 8/1905 | Chayes | 24/702 |
| 987,469 | 3/1911 | Lewis | 24/583 |
| 1,941,258 | 12/1933 | Gordon | 248/58 |
| 2,455,236 | 11/1948 | Darvie et al. | 24/580 |
| 2,461,201 | 2/1949 | Ellis | 24/575 |
| 2,956,324 | 10/1960 | Klein | 24/702 |
| 3,080,635 | 3/1963 | Gunther | 24/579 |
| 3,765,062 | 10/1973 | Cruse | 24/575 |
| 3,979,801 | 9/1976 | Tareau | 24/580 |
| 4,052,774 | 10/1977 | Noda . | |
| 4,161,806 | 7/1979 | Hennissee et al. | 24/580 |
| 4,310,953 | 1/1982 | Nanasi | 24/656 |

FOREIGN PATENT DOCUMENTS

| | | | |
|---|---|---|---|
| 2296352 | 8/1976 | France | 24/702 |
| 280924 | 2/1952 | Switzerland | 24/582 |

*Primary Examiner*—Victor N. Sakran

*Attorney, Agent, or Firm*—Cushman, Darby & Cushman

[57] ABSTRACT

The disclosure herein describes a strap buckle which comprises a male element and a female element, each having a strap engaging portion on one side thereof; the male element has a female engaging part on its opposite side which includes a T-shaped edge member and first locking members; the female element has a male engaging part on its opposite side and is formed of a housing having a shape corresponding to that of the T-shaped edge member, the housing including further locking members which are engageable with the locking members on the male element. To release the buckle, two operations are required: a first lateral movement which consists in forcing the female and male elements towards one another thereby applying pressure against the spring blade to free the interengaged locking members, and a second continuous movement which is normal to the first movement which consists in moving, parallel to and away from one another, the T-shaped member and the housing while maintaining pressure on the spring blade.

5 Claims, 9 Drawing Figures

STRAP BUCKLE

FIELD OF THE INVENTION

The present invention relates to a buckle and, more particularly, to a buckle or fastener for securing the opposite ends of flexible articles such as belts, straps and the like.

BACKGROUND OF THE INVENTION

There are many types of fasteners such as buckles. They take various shapes and forms and one of the main features desired in most fasteners is the possibility of a quick release. However, very often this feature will cause accidental unwanted release of the connected parts on account of important forces which may be exerted on the devices. One application of buckles for which a quick release is not wanted is that when used with saftey and rescue vests, particularly those which are worn by persons working on scaffolds or high-rise construction buildings and where the vest is hooked to a connecting cable which, in turn, is anchored to some safe attachment points on the building. An important impact is suffered by the buckle and strap arrangement when an accidental fall by the worker is abruptly stopped due to the cable connection. One example of a vest using a strap and buckle arrangement of the type described may be found in applicant's copending patent application filed concurrently herewith. With the vest described in this co-pending application, it is extremely important that the buckle construction be tightly secured and safe since the buckle components must remain constantly attached together while the user is working as well as when a fall occurs.

OBJECTS AND STATEMENT OF THE INVENTION

It is an object of the present invention to provide a buckle which is safe in that unfastening cannot be easily and accidently effected.

It is a further object of the present invention to provide a buckle where unfastening will only occur as a result of two separate operations thus making it difficult to separate the male element from the female element forming part of the buckle. In the present invention, these two operations consist in a first movement which is in a direction towards one another and a second continuous parallel movement, normal to the first movement, while maintaining the effect of the first movement.

The present invention therefore relates to a strap buckle which comprises a male element and a female element, each having a strap engaging portion on one side thereof; the male element includes a female engaging part on the opposite side that includes an elongated edge member having a top section and a T-shaped section including a stem portion and a web portion with an outer surface and two opposite inner surfaces as well as first locking means on each inner surface. The female element includes a male engaging part on its opposite side which includes an elongated hollow housing being so shaped as to engagedly receive the edge member therein; the housing has an outer slotted wall to receive the stem portion therein and an inner wall facing the web outer surface when the male and female elements are engaged to one another; also second locking means are provided on the inner face of the slotted wall and are adapted to interfittingly engage with the first locking means of the male element. Spring means are provided on the inner wall of the housing and are adapted to contact the web outer surface when the male and female elements are inter-engaged; the spring means maintain the first and second locking means in interlocking engagement whereby disengagement of the female and male elements is effected through two movements: a first lateral movement pressing the web face against the spring means to free the first and second locking means from one another and a second movement, normal to the first movement, displacing longitudinally and parallel to one another the edge member and the housing while maintaining pressure against the spring means.

In one preferred form of the invention, the spring means consists of a longitudinally extending blade which is secured to the inner wall of the housing and which faces the slot of the slotted wall.

Other objects and further scope of applicability of the present invention will become apparent from the detailed description given hereinafter. It should be understood, however, that this detailed description, while indicating preferred embodiments of the invention, is given by way of illustration only since various changes and modifications within the spirit and scope of the invention will become apparent to those skilled in the art.

DESCRIPTION OF PREFERRED EMBODIMENTS

Figure 2:
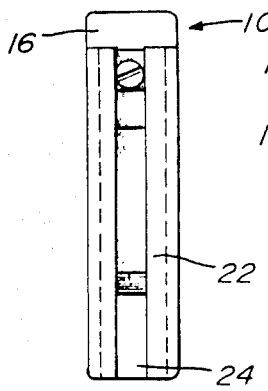
FIG. 2 is an end view as seen from the right of FIG. 1.
Figure 1:
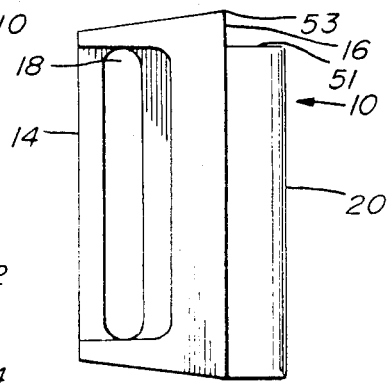
FIG. 1 is an elevation of the female element of the buckle made in accordance with the present invention.
Figure 3:
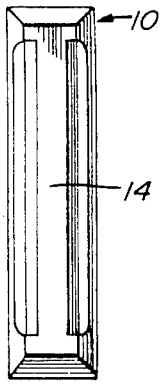
FIG. 3 is an end view as seen from the left of FIG. 1.
Figure 4:
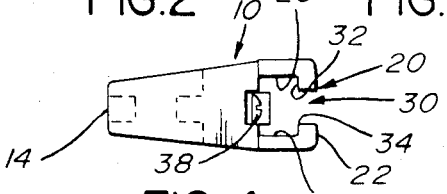
FIG. 4 is a top view thereof.

Referring to the drawings wherein like reference numerals refer to like parts throughout the several views, one form of the buckle is indicated as comprising a female element 10 (FIGS. 1–5) and a male element 12 (FIGS. 6–9).

Figure 5:
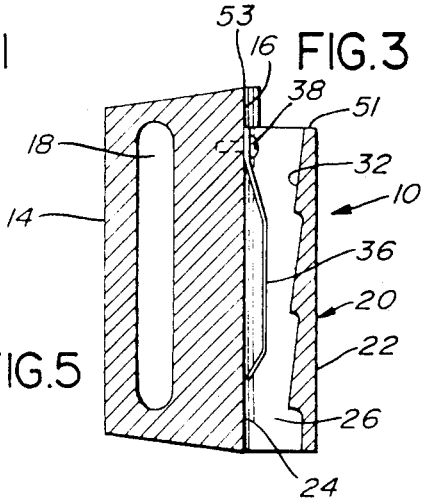
FIG. 5 is a cross-sectional elevation thereof.
Figure 7:
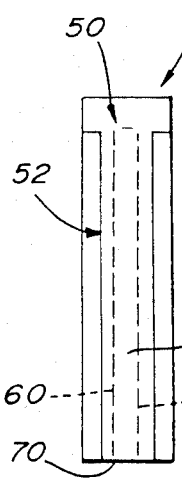
FIG. 7 is an end view as seen from the left of FIG. 6.

The female element 10 comprises a body made of strong material, preferably metal, having a trapezoidal shape in cross-section with a narrow side 14 and a larger opposite side 16. The short side 14 displays an adjacent elongated opening 18 which serves to receive a belt, strap or like element, to which the buckle is to be attached. The wider side 16 displays an outwardly projecting housing 20, the height of which is slightly smaller than that of the adjacent side wall 16. The housing which is rectangular in cross-section, includes a front wall 22, a rear wall 24 and two opposite side walls 26 and 28. The front wall 22 has a slot 30 extending lengthwise thereof thus defining two inner faces 32 and 34. Each of these two inner faces has a tooth configuration, such as illustrated in FIG. 5, the function of which will be described hereinbelow. The rear wall 24 displays a downwardly extending spring blade 36 which is attached to wall 24 by means of a screw 38 and which projects away therefrom into the middle of the housing.

Figure 6:
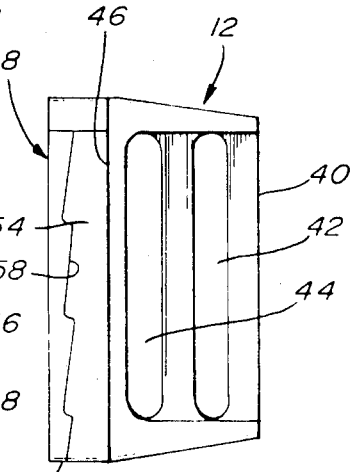
FIG. 6 is an elevation of the male element of the buckle made in accordance with the present invention.
Figure 8:
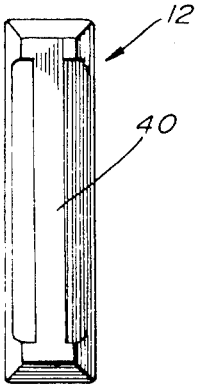
FIG. 8 is an end view as seen from the right of FIG. 6.
Figure 9:
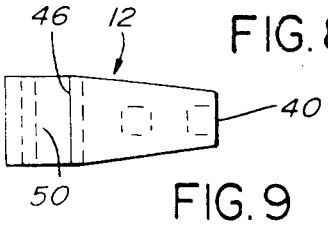
FIG. 9 is a top view thereof.

Referring to FIGS. 6–9, the male element is also made of a rigid material, preferably metal, and has a trapezoidal shape in cross-section similar to that of the female element 10. The male element has, on one side 40 thereof, a pair of elongated openings 42 and 44 in order to allow a belt, strap or like element, to be fixedly attached thereto. From the opposite wall 46 thereof, projects an edge member 48 having a top section 50 and a T-shaped lower section 52. The thickness of the top section 50 corresponds to the gap left between the top face 51 of housing 20 and the upper edge 53 of sidewall 16 of the female element 10. Hence, when the two elements are engaged, the top section 50 sits on the top face 51 of the housing. The T-shaped lower section 52 includes a narrow stem portion 54 and a thicker web portion 56, defining two inner surfaces 58 and 60, each having a toothed configuration such as shown in FIG. 6. This shape is complementary to that of the two inner faces 32 and 34 of the female element 10.

To assemble the female and male elements, the web portion 56 of the male element is inserted in the housing 20 from the top face 51 with the stem portion 54 being lowered in slot 30. This downward sliding motion causes the spring blade 36 to be pushed back against wall 24. Once the web portion 56 is entirely received in the housing, the spring blade 36 forces the toothed configuration of inner faces 58 and 60 to engage and lock with the toothed configuration of the inner faces 32 and 34. Therefore, during use, the spring ensures a constant locking engagement between the two elements.

To disengage the buckle elements, two operations are needed. First, the female and male elements are forced toward one another forcing the spring blade against the wall 24 thus disengaging the toothed configurations. Also, a second movement is required which is normal to the first movement, i.e. a vertical movement sliding web portion 56 out of the housing until the lower extremity 70 of the lower section has passed the top face 51 of the housing. However, this second movement is carried out in a continuous manner, maintaining face 46 against face 16 thus maintaining a constant pressure against the spring blade or else the toothed configurations will engage one another and stop the upward movement of disengagement. The combination of these two movements provide a safe buckle and its disengagement can only be effected manually and intentionally since both movements must be carried out to effect complete disengagement. Hence, an accidental impact on the elements is not likely to disengage the two elements from one another since such impact in only carried out in only one direction.

Although the invention has been described above in relation to one form thereof, it will be evident to the person skilled in the art that it may be modified and refined in various ways. For example, this type of buckle may be used in applications other than by workers on scaffolds or high-rise construction buildings; therefore, it can be envisaged that it could be made of a material other than rigid metal, such as a rigid plastic. It is therefore wished to have it understood that the present invention should not limited in interpretation except by the terms of the following claims.

The embodiments of the invention in which an exclusive property or privilege is claimed are defined as follows:

1. A strap buckle comprising:

(a) a male element including (i) a strap engaging portion on one side thereof; and (ii) a female-engaging part on the opposite side thereof, said female-engaging part including an elongated edge member having a top section and T-shaped lower section including a stem portion and a web portion, said web portion having an outer surface and two opposite inner surfaces; first locking means on each said inner surface;

(b) a female element including (i) a strap engaging portion on one side thereof; and (ii) a male-engaging part on the opposite side thereof, said male-engaging part including an elongated hollow housing being so shaped as to engagedly receive said edge member of said male element therein; said housing having an outer wall slotted to receive said stem portion and an inner wall facing the outer surface of said web portion when said male and female elements are engaged to one another; second locking means on the inner face of said slotted wall adapted to interfittingly engage said first locking means of said male element;

(iii) spring means on said inner wall of said housing adapted to forceably contact said web outer surface when said male and female elements are interengaged; said spring means maintaining said first and second locking means in interlocking engagement whereby disengagement of said female and male elements is effected through two movements: a first lateral movement pressing said web outer surface against said spring means to free said first and second locking means from one another, and a second movement, normal to said first movement, displacing longitudinally said edge member out of said housing while maintaining said web outer surface against spring means.

2. A strap buckle as defined in claim 1, wherein said first and second locking means each comprising a surface having a toothed configuration complementary in shape.

3. A strap buckle as defined in claim 1 or 2, wherein said spring means comprising a longitudinally extending spring blade secured to said inner wall and facing the slot of said slotted wall.

4. A strap buckle as defined in claim 1, wherein the top section of said edge member sits on an uppermost edge of said hollow housing when both elements are engaged to one another.

5. A strap buckle as defined in claim 1, wherein said stem portion of said T-shaped section has a width slightly smaller than the slot of said slotted wall.

* * * * *